US006663258B1

(12) United States Patent
Kanter

(10) Patent No.: US 6,663,258 B1
(45) Date of Patent: Dec. 16, 2003

(54) PORTABLE ILLUMINATION DEVICE

(76) Inventor: Hartmut Kanter, Bindower Strasse 3, D-15754 Dolgenbrodt (DE)

( * ) Notice: Subject to any disclaimer, the term of this patent is extended or adjusted under 35 U.S.C. 154(b) by 0 days.

(21) Appl. No.: 09/913,172

(22) PCT Filed: Feb. 10, 2000

(86) PCT No.: PCT/EP00/01075

§ 371 (c)(1),
(2), (4) Date: Aug. 9, 2001

(87) PCT Pub. No.: WO00/47929

PCT Pub. Date: Aug. 17, 2000

(30) Foreign Application Priority Data

Feb. 11, 1999 (DE) ..... 299 03 168 U

(51) Int. Cl.[7] ..... F21L 19/00; F21L 19/04

(52) U.S. Cl. ..... 362/159; 362/157; 362/266; 431/100; 431/298

(58) Field of Search ..... 362/159, 157, 362/266; 431/100, 298

(56) References Cited

U.S. PATENT DOCUMENTS

| | | | |
|---|---|---|---|
| 3,721,516 | A | 3/1973 | Reese |
| 5,902,101 | A | 5/1999 | Palmer |

FOREIGN PATENT DOCUMENTS

| | | | |
|---|---|---|---|
| DE | 64320 | | 9/1892 |
| DE | 1 529 210 | | 12/1969 |
| DE | 24 40 068 | A1 | 3/1976 |
| DE | 36 07 603 | A1 | 9/1986 |
| DE | 43 24 834 | A1 | 1/1994 |
| DE | G 94 16 100.3 | U1 | 2/1995 |
| DE | 295 03 871.3 | U1 | 6/1995 |
| FR | 2 690 516 | A1 | 10/1993 |

*Primary Examiner*—Sandra O'Shea
*Assistant Examiner*—James W Cranson, Jr.
(74) *Attorney, Agent, or Firm*—Hahn Loeser +Parks LLP; Stephen L. Grant

(57) ABSTRACT

This invention relates to a portable illumination device (1) for the production of light effects, with a carrier (3) and a light-emitting device (2) operated with an open flame and connectable to this carrier. Carrier (3) comprises a handle (4) essentially designed as a hollow cylinder, which carries a shield-type flame protector (5) at one end. The light-emitting device is a gas lighter (2) arranged inside handle (4).

35 Claims, 4 Drawing Sheets

PORTABLE ILLUMINATION DEVICE

Figure 1:
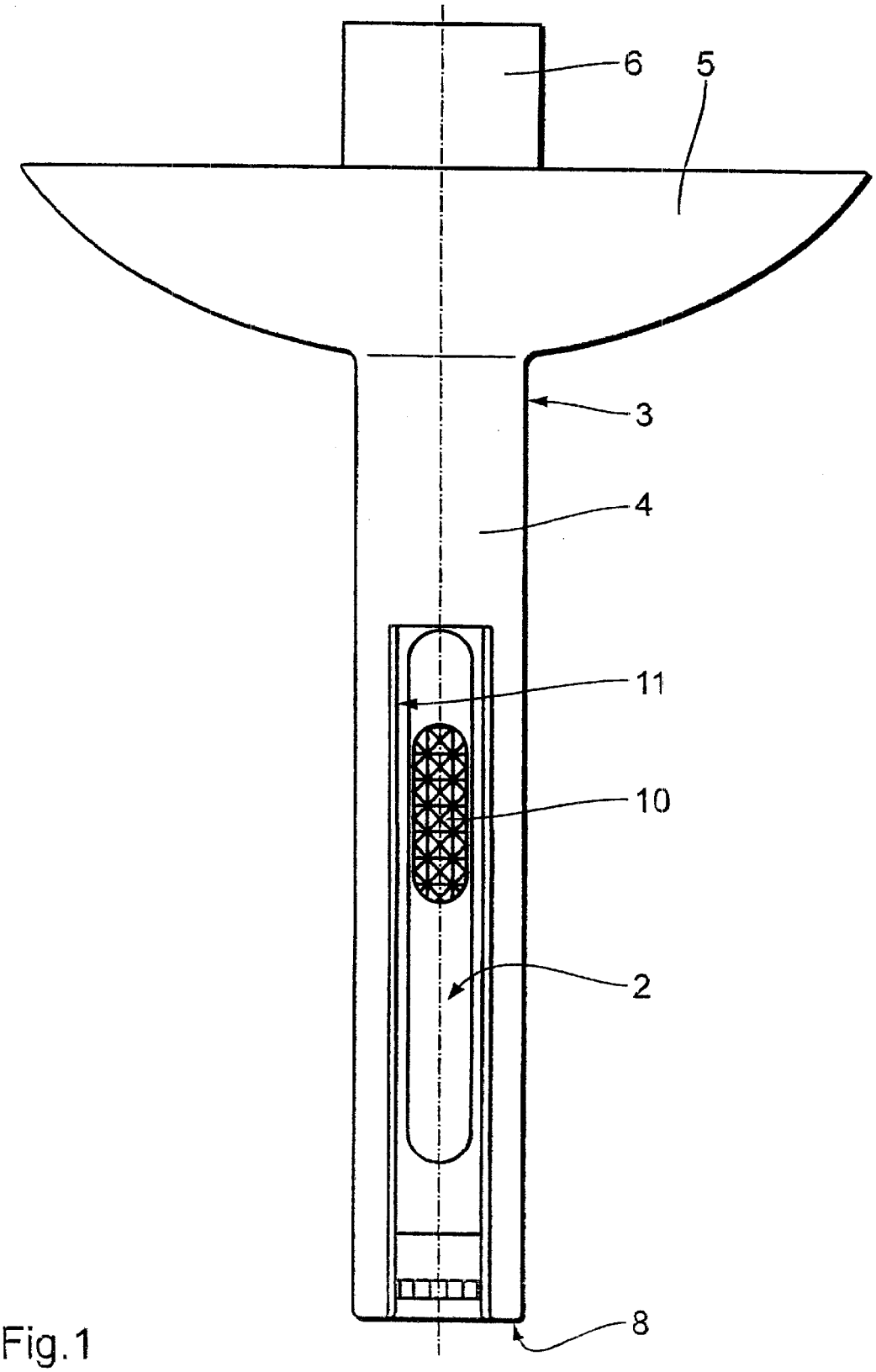

This invention relates to a portable illumination device according to the characterizing clause of claim 1.

During large events, especially outdoor concerts of popular music groups and similar performers, some members of the audience like to use illumination devices to express their support for a particular song or singer.

The selection of available illumination devices ranges from flashlights to cigarette lighters to sparklers, where cigarette lighters—and especially modern gas lighters—enjoy great popularity.

The German Gebrauchsmuster DE 94 16 100 U1 discloses a torch holder manufactured from several pieces made of wood. The torch holder comprises a round bar as its carrier, which—at one end—carries a holding device for a candle or a torch.

A wooden plate attached to the bottom of the holding device is penetrated by the round bar inserted into the holding device and protects at least the person carrying the torch from the flame or falling residue of combustion.

Known illumination devices have the disadvantage consisting in the fact that, on the one hand, during the use of such devices at public events, especially at festivities attended by a large crowd, the flame is freely accessible thus creating a source of danger, and, on the other hand, e.g., with a sparkler or a torch, residue of combustion may fall off.

Furthermore, the open, unprotected flame can—under the influence of the wind—flash out and thus affect even a larger range in an unfavorable manner.

Persons within a close range of an operated illumination device are especially endangered since burns or damage to their clothing can not always be excluded. This danger is even enhanced with the crowd gradually getting excited and losing general caution.

Based on the shortcomings of previous art, this invention's task is to disclose an illumination device of the aforementioned type that provides a higher user value due to an improved fire protection.

This task is fulfilled by the features of the characterizing clause in claim 1.

This invention comprises the knowledge that fire-protection improvements of an illumination device with open flame are attainable by designing measures that substantially impede direct access to the open flame, and restrict, as much as possible, the effect of weather-dependent circumstances.

According to this invention, the portable illumination device for the production of light effects is equipped with a carrier with inserted light-emitting device operated with an open flame. In order to reduce the danger posed by an open flame to the maximum and in an advantageous manner, the carrier comprises a handle that is substantially configured as a hollow cylinder, which carries a shield-type flame protector at one end.

According to a preferred design version of the invention, the flame protection is designed as a spherical cap installed on the handle in a rotationally symmetrical manner. Such fire-protection device ensures, in a simple manner, a safety distance between the open flame and combustible objects and, at the same time, restricts direct access to the open flame.

The light-emitting device is a gas lighter arranged inside the handle. The gas lighter is designed in the form of a cylinder and can be easily inserted inside the handle. In order to ensure that the control elements are always accessible with this arrangement of the gas lighter, the cylinder wall of the handle of the illumination device according to this invention comprises, in an advantageous manner and at its end opposite to the fire-protection device, an essentially notch-like expansion extending along the longitudinal axis of the cylinder. It is sufficient for the width of the notch to be about 25% of the cylinder circumference, and for the notch length to be at least 50% of the length of the handle. The gas lighter is advantageously designed as a refillable gas lighter. For safety reasons, the [combustion occurs and] flame exists only while the operator presses the control element; as soon as the control element is released, the flame extinguishes.

According to a preferred design version of this invention, the inner wall of the illumination device's handle, which is open at both ends, comprises a holding device for the gas lighter that fixes the gas lighter in a position required for its lighting if the illumination device is to be used.

In an advantageous design form of the illumination device according to this invention, the holding device is designed as a leaf spring extending in the direction of the longitudinal axis of the handle. The gas lighter inserted in the carrier presses the leaf spring against the cylindrical inner wall of the handle—while overcoming the leaf spring's force—thus producing a force component pressing the shell surface of the gas lighter against the delimiting edges of the opposite notch-like expansion.

The leaf spring's end opposite to the spherical cap is glued, in a suitable manner, to the inner wall of the handle. This arrangement allows the leaf spring to sufficiently extend.

According to another advantageous design version of this invention, the fire-protection component of the illumination device comprises an additional wind shield designed to reduce the danger of undesired flashing out of the flame due to airflow. The wind shield-is designed in the form of a tube attached, in a detachable manner, by inserting on a ring flange inside the cap-like flame protection device. The inner diameter of the wind shield and the outer diameter of the ring flange are designed in such a manner as to create a sufficient form and frictional closure and connection between the wind shield and the ring flange so that the wind shield can still be safely attached even after multiple removals.

The wind shield comprises, at one end and on its inner wall, a chamfering allowing to easily slip the wind shield on the end of the handle opposite to the spherical flame-protection cap whenever the wind shield is not being used. The slipping of the wind shield on this end of the handle ensures not only its safe storage but, at the same time, serves the purpose of supporting the force of the leaf spring fixing the gas lighter.

In order to achieve a sufficient protection against undesired effects of air flow, it suffices that the wind shield overlaps the upper edge of the flame protection device by about one third of its length.

An advantageous variant of the invention comprises the carrier of the illumination device fabricated as an aluminum injection-molded part. This makes the carrier fireproof, sufficiently mechanically stable, and allows economical manufacturing of this part in mass production. The spherical flame protector can be attached to the handle also in a detachable manner.

Figure 2:
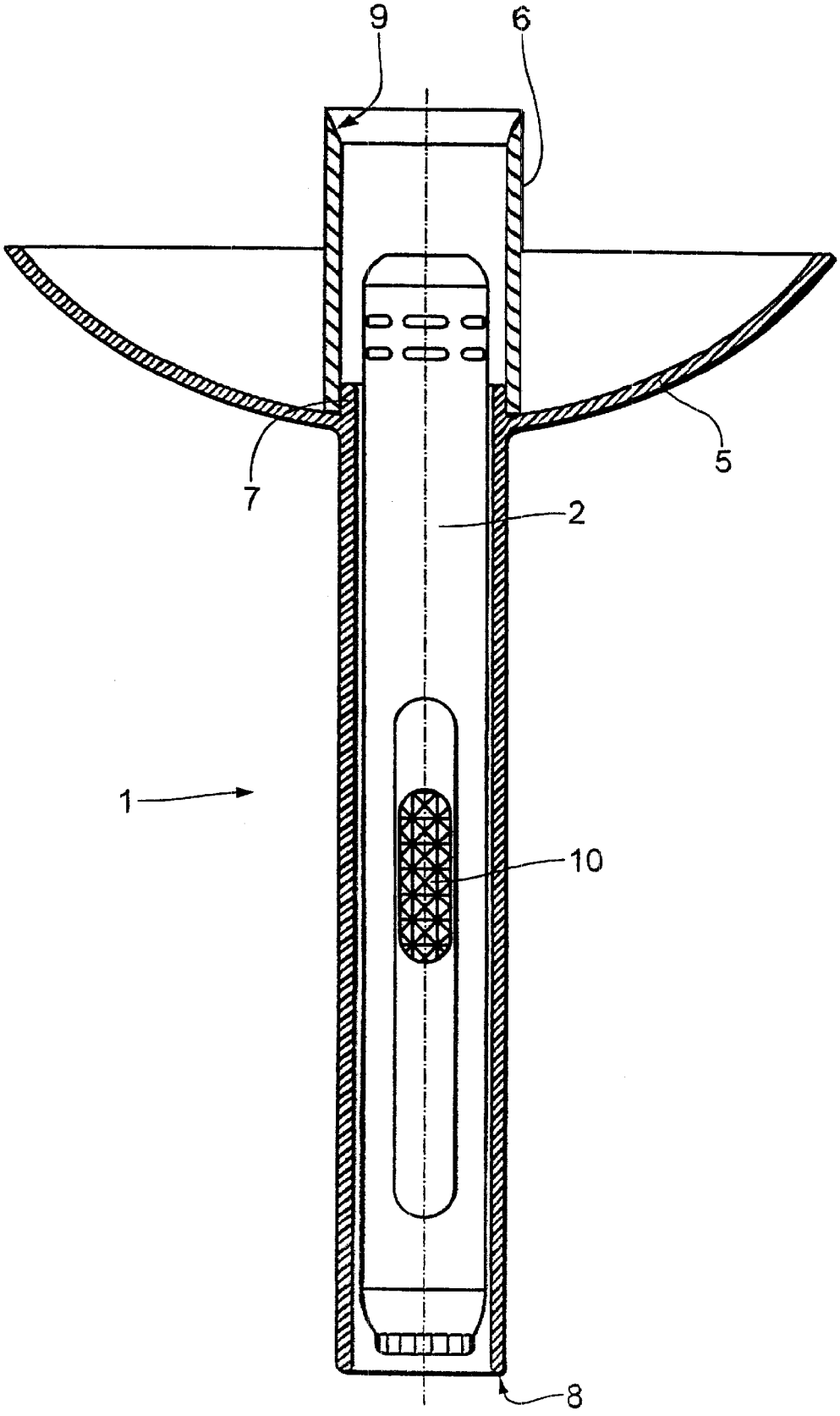
Figure 3:
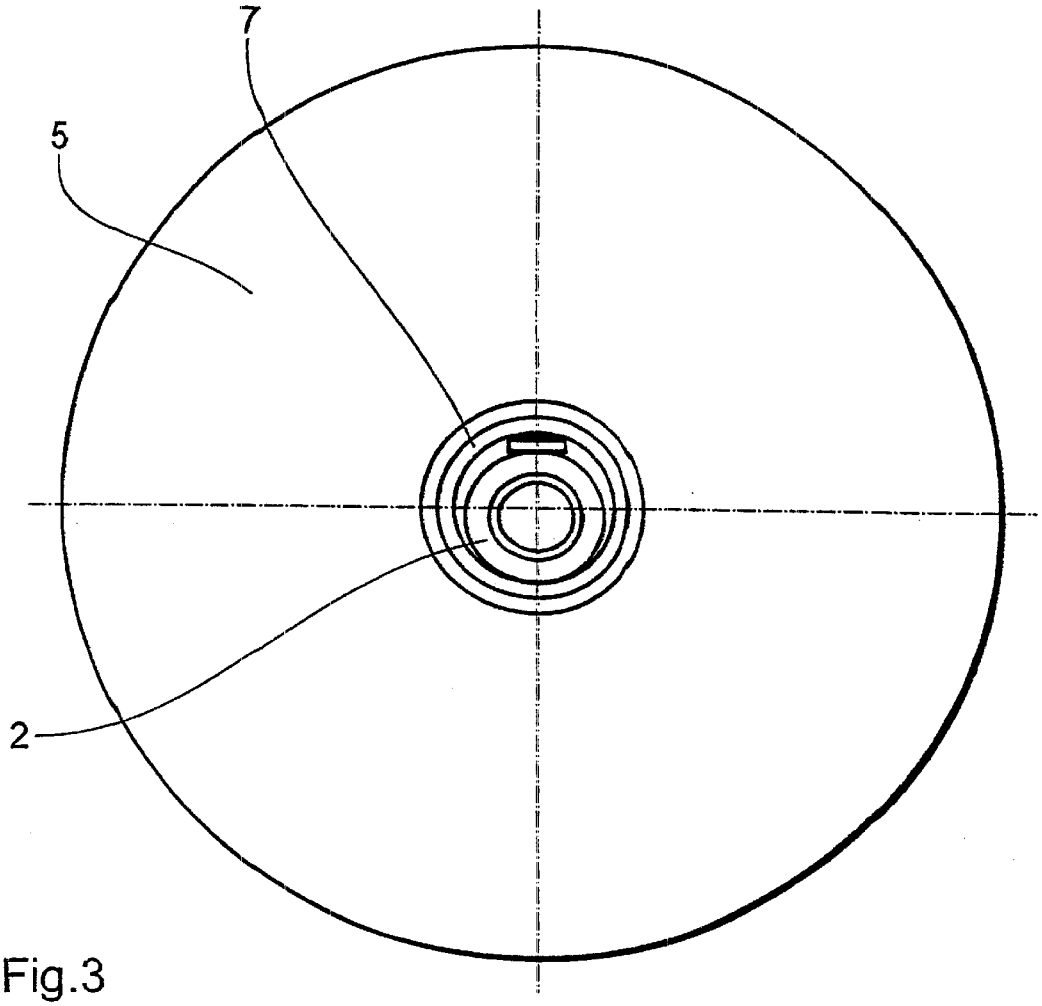
Figure 5:
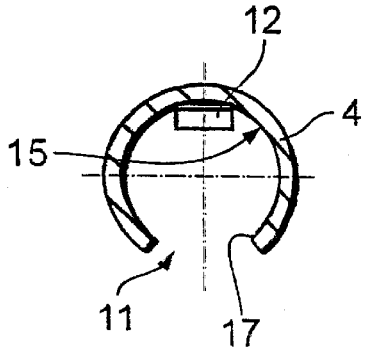
Figure 4:
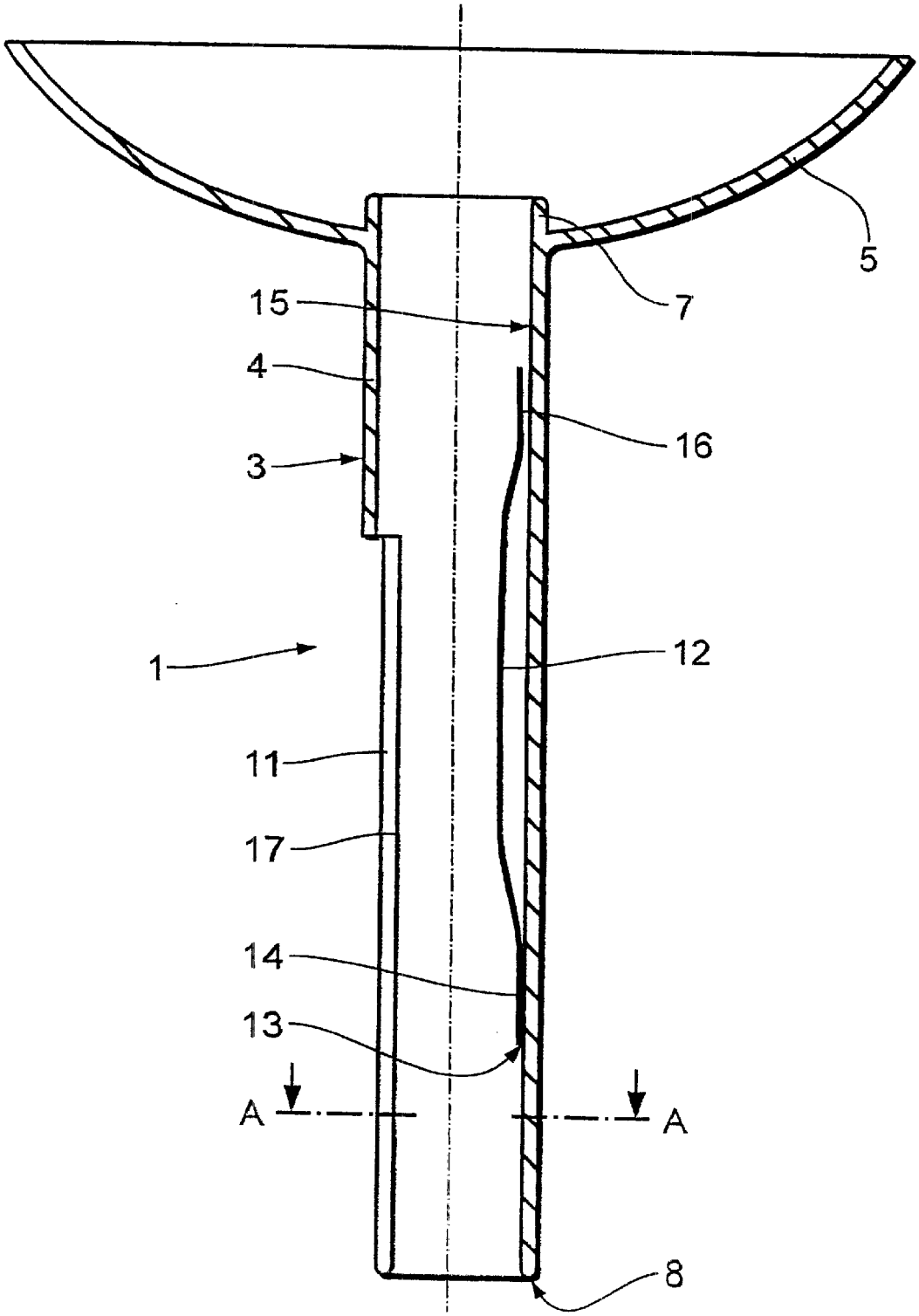

Other advantageous design versions of this invention are characterized in sub-claims or are explained in the following text with a description of the preferred design forms of the invention using individual figures. The figures show:

FIG. 1 A preferred design version of this invention in side view,

FIG. 2 The view in longitudinal section of the design version of this invention shown in FIG. 1, FIG. 3 the design version of this invention shown in FIG. 1 in view from the top, FIG. 4 longitudinal section of the handle of the design version of this invention shown in FIG. 1, and FIG. 5 View of a section along the line A . . . A as shown in FIG. 4.

The illumination device 1 shown in FIGS. 1, 2, and 3 is operated by a gas lighter 2 and comprises a carrier 3 preferably made of aluminum and fabricated as an injection-molded part. Carrier 3 consists of a handle 4 to handle the illumination device, and a flame protector 5, which is tip-stretched on or attached to handle 4 in a detachable manner. Gas lighter 2 is inserted into handle 4 so deep that its gas-outlet nozzle is located inside the space surrounded by the flame protector.

Flame protector 5 has the shape of a spherical cap and ensures that the danger of direct access to the open flame produced during the operation of illumination device 1 is reduced if the device is used properly and for its designed purpose.

The installation of a wind shield 6 enhances the safety and protection of objects and persons from the open flame during the operation of illumination device 1 at an outdoor event attended by a large crowd. The wind shield prevents, to a large extent, the flame from extinguishing or flashing out due to airflow caused by the natural environment, which could otherwise result in unforeseeable damage.

Wind shield 6 is slipped on a ring flange 7 located inside spherical cap 5 or otherwise fixed to it in a detachable manner, and can be removed at any time if the flame is not expected to flash out in a dangerous way, e.g., with only very slight air movement or if illumination device is being used indoors. In such case, wind shield 6 can be easily slipped on end 8 of handle 4 opposite to spherical cap 5, and can be carried along. A chamfering 9 on the inner side of wind shield 6 facilitates the slipping of the wind shield on handle 4.

The ignition mechanism of gas lighter 2 is controlled by a button 10. For this purpose, handle 4 is equipped with a notch-like expansion 11 allowing to reach control button 10 of gas lighter 2 located inside handle 4 and held there by clamping. The clamping force is produced by a separate holding device (cf. item 12 in FIGS. 4 and 5), which is arranged on the inner wall of handle 4. To produce a flame, button 10 must be actively pressed and held. If the button is released, the flame extinguishes. However, a design with a permanent flame is also possible.

FIGS. 4 and 5 illustrate the position of holding device 12 whose purpose is to fix the gas lighter. The holding device is designed in the form of a leaf spring 12 and is glued, at its one end, to the inner side of handle 4 of carrier 3. The glued joint is marked with 13 and fixes end 14 of leaf spring 12 opposite to flame protector 5. This allows leaf spring 12 to sufficiently extend when gas lighter 2 is being inserted into handle 4. In this process, leaf spring 12 is pressed, against the effect of the spring force, to inner side 15 of the handle, and free end 16 of the leaf spring moves in the direction of flame protector 5.

The shell of the gas lighter being inserted is pressed against delimiting edges 17 of notch-like expansion 11 by the effect of leaf spring 12. The application pressure holds gas lighter 2 in the desired position and, at the same time, protects it from twisting. Therefore, operation button 10 can be pressed to light the device without any risk of undesired shifting of gas lighter 2.

Another advantageous design form to hold gas lighter 2 inserted in handle 4—which is, however, not shown in the Figures—is a centering collar arranged along the inner circumference of handle 4 and comprising radial ribs sticking out into the inner space. Such collar can be designed along the entire length of handle 4 or as individual spaced rings. Elastic brackets spaced along the inner circumference or a seat-engaging device for gas lighter shell 2 in handle 4 are also possible.

Carrier 3 of illumination device 1, designed as an aluminum injection-molded part, has preferably an anodic-oxidized surface, where the coloring can be selected according to the prevailing fashion trend.

This invention is not restricted to the aforementioned examples of design versions. There are a number of possible variants using the illustrated solution even if their particular design is different.

What is claimed is:

1. A portable illumination device for the production of light effects when held by a user, comprising:

a carrier and a light-emitting device connectable with the carrier and operated by an open flame, wherein the carrier comprises a handle essentially designed as a hollow cylinder carrying, at one end, a shield-like flame protector, and wherein the light-emitting device is a gas lighter arranged inside the handle, with operation elements of the gas lighter contained in the handle wall and adapted such that the gas lighter operates only when the operation elements are actively pressed by the user.

2. The device according to claim 1, wherein the flame protector is designed in a rotationally symmetrical form.

3. The device according to claim 2, wherein the flame protector has the shape of a spherical cap.

4. The device of claim 3, wherein the operation elements of the gas lighter are contained, at an end opposite the flame protector, in an essentially notch-like expansion extending along the longitudinal axis of the cylinder.

5. The device according to claim 4, wherein the width of the notch is about 25% of the cylinder circumference, and the notch length is at least 50% of the length of handle.

6. The device of claim 5, wherein a holding device for the gas lighter is installed on an inner wall of the handle, which is open at both ends.

7. The device of claim 6, wherein a wind shield is installed on the flame protector.

8. The device according to claim 7, wherein the wind shield is designed in the form of a tube attached to a ring flange inside the flame protector.

9. The device according to claim 8, wherein the wind shield is made of metal and is arranged in a detachable manner.

10. The device of claim 9, wherein the wind shield overlaps an upper edge of the flame protector by about one-third of its length.

11. The device of claim 10, wherein the carrier and the wind shield are designed as aluminum injection-molded parts.

12. The device according to claim 11, wherein a colorfully finished surface is achieved by anodic oxidation.

13. The device of claim 10, wherein the shield-like flame protector is attached to the handle in a detachable manner.

14. The device of claim 1, wherein the cylinder wall of handle comprises, at an end opposite the flame protector, an essentially notch-like expansion extending along the longitudinal axis of the cylinder and containing operation elements of the gas lighter.

15. The device according to claim 4, wherein the width of the notch is about 25% of the cylinder circumference, and the notch length is at least 50% of the length of handle.

16. The device of claim 15, wherein a holding device for the gas lighter is installed on an inner wall of handle, which is open at both ends.

17. The device of claim 1, wherein a holding device for the gas lighter is installed on an inner wall of handle, which is open at both ends.

18. The device of claim 6, wherein a wind shield is installed on the flame protector.

19. The device of claim 17, wherein a wind shield is installed on the flame protector.

20. The device of claim 1, wherein a wind shield is installed on the flame protector.

21. The device according to claim 18, wherein the wind shield is designed in the form of a tube attached to a ring flange inside the flame protector.

22. The device according to claim 19, wherein the wind shield is designed in the form of a tube attached to a ring flange inside the flame protector.

23. The device according to claim 20, wherein the wind shield is designed in the form of a tube attached to a ring flange inside the flame protector.

24. The device according to claim 21, wherein the wind shield is made of metal and is arranged in a detachable manner.

25. The device according to claim 22, wherein the wind shield is made of metal and is arranged in a detachable manner.

26. The device according to claim 23, wherein the wind shield is made of metal and is arranged in a detachable manner.

27. The device of claim 24, wherein the wind shield overlaps an upper edge of the flame protector by about one-third of its length.

28. The device of claim 25, wherein the wind shield overlaps an upper edge of the flame protector by about one-third of its length.

29. The device of claim 26, wherein the wind shield overlaps an upper edge of the flame protector by about one-third of its length.

30. The device of claim 27, wherein the carrier and the wind shield are designed as aluminum injection-molded parts.

31. The device of claim 28, wherein the carrier and the wind shield are designed as aluminum injection-molded parts.

32. The device of claim 29, wherein the carrier and the wind shield are designed as aluminum injection-molded parts.

33. The device of claim 1, wherein the shield-like flame protector is attached to the handle in a detachable manner.

34. A portable illumination device for the production of light effects, comprising:

a carrier comprising a hollow cylinder handle, open on both ends thereof;

the carrier having a shield-like flame protector at the first end thereof;

the carrier having a notch-like expansion at the second end thereof, the notch-like expansion extending along a longitudinal axis of the cylinder, the notch-like expansion having a width of about 25% of the cylinder circumference, and a length of at least 50% of the handle length;

a light-emitting device connectable with the carrier and operated by an open flame;

the light-emitting device being a gas lighter held inside the handle by a holding device on an inner wall of the handle;

a set of operational elements of the gas lighter contained in the notch-like expansion;

the flame protector being in the shape of a spherical cap;

a wind shield installed on the flame protector, the wind shield comprising a tube attached to a ring flange inside the flame protector;

the wind shield made of metal and arranged in a detachable manner;

the wind shield overlapping an upper edge of the flame protector by about one-third of its length; and the flame protector attached to the handle in a detachable manner.

35. A portable illumination device for the production of light effects, comprising:

a carrier and a light-emitting device connectable with the carrier and operated by an open flame, wherein the carrier comprises a handle essentially designed as a hollow cylinder carrying at one end, a shield-like flame protector in the shape of a spherical cap, and wherein the light-emitting device is a gas lighter arranged inside the handle, a cylinder wall of which comprises, at an end opposite the flame protector, an essentially notch-like expansion extending along the longitudinal axis of the cylinder and containing operation elements of the gas lighter, a width of the notch being about 25% of the cylinder circumference, and a notch length being at least 50% of the length of handle.

* * * * *